US006911423B2

(12) United States Patent
Garrett et al.

(10) Patent No.: US 6,911,423 B2
(45) Date of Patent: Jun. 28, 2005

(54) GRANULAR COMPOSITION

(75) Inventors: Peter Robert Garrett, Flint (GB); John Edley Wilson, Wirral (GB)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 361 days.

(21) Appl. No.: 10/144,995

(22) Filed: May 14, 2002

(65) Prior Publication Data

US 2003/0022808 A1 Jan. 30, 2003

(30) Foreign Application Priority Data

May 15, 2001 (GB) ..... 0111862

(51) Int. Cl.[7] ..... C11D 11/00; C11D 1/83; C11D 1/831

(52) U.S. Cl. ..... 510/356; 510/438; 510/444; 510/349; 510/507; 428/404

(58) Field of Search ..... 510/349, 356, 510/357, 438, 507, 441–446; 428/404

(56) References Cited

U.S. PATENT DOCUMENTS

| | | | | |
|---|---|---|---|---|
| 3,868,336 A | | 2/1975 | Mazzola et al. | 252/527 |
| 4,675,124 A | | 6/1987 | Seiter et al. | 252/91 |
| 5,514,295 A | | 5/1996 | Flower | 252/174 |
| 5,516,447 A | | 5/1996 | Bauer et al. | 252/89.1 |
| 5,578,561 A | | 11/1996 | Sakamoto et al. | 510/349 |
| 5,591,707 A | | 1/1997 | Raehse et al. | 510/451 |
| 5,610,131 A | | 3/1997 | Donoghue et al. | 510/444 |
| 5,654,265 A | | 8/1997 | Kuroda et al. | 510/507 |
| 5,736,501 A | * | 4/1998 | Yamashita et al. | 510/444 |

FOREIGN PATENT DOCUMENTS

| | | |
|---|---|---|
| CA | 2 308 932 | 5/2000 |
| CA | 2308910 | 11/2000 |
| DE | 199 23 626 | 11/2000 |
| EP | 265 203 | 4/1988 |
| EP | 0 354 331 | 2/1990 |
| EP | 521 635 | 1/1993 |
| EP | 544 365 | 6/1993 |
| EP | 622 454 | 11/1994 |
| EP | 648 259 | 4/1995 |
| EP | 694 608 | 1/1996 |
| EP | 0 799 884 | 10/1997 |
| EP | 1 085 080 | 3/2001 |
| GB | 1 578 288 | 11/1980 |
| WO | 92/06150 | 4/1992 |
| WO | 94/09109 | 4/1994 |
| WO | 97/32952 | 9/1997 |
| WO | 98/11198 | 3/1998 |
| WO | 99/46359 | 9/1999 |

OTHER PUBLICATIONS

PCT International Search Report in a PCT application PCT/EP 02/05076 Jul. 10, 2002.

PCT International Search Report in a PCT application PCT/EP 02/05091 Sep. 10, 2002.

Derwent Abstract of EP 0 354 331—published Feb. 14, 1990.

Co–pending Application: Applicant: Instone et al., U.S. Appl. No. 10/145,011, Filed May 14, 2002.

* cited by examiner

*Primary Examiner*—Margaret Einsmann
(74) *Attorney, Agent, or Firm*—Rimma Mitelman

(57) ABSTRACT

In order to improve the dispersion of nonionic surfactant into wash water from a granule in which the nonionic surfactant is carried on a water-insoluble granular material, the nonionic surfactant is intimately mixed with a structurant which is a non-soap ionic surfactant in finely divided particulate form. A preferred structurant is an anionic surfactant, for example, primary alcohol sulphate.

19 Claims, No Drawings

GRANULAR COMPOSITION

TECHNICAL FIELD

The present invention relates to granular compositions containing structured nonionic surfactant, for use in particulate laundry detergent compositions.

BACKGROUND AND PRIOR ART

It is frequently desired to include nonionic surfactant in granular laundry detergent compositions as it gives good oily soil detergency and can reduce foam levels, which is beneficial in detergent compositions for use in automatic washing machines.

Nonionic surfactant may be introduced into granular detergent compositions during the manufacture thereof along with other components such as anionic surfactants, builders etc. manufacturing requirements can place an upper limit to the amount of nonionic surfactant which can be included.

Detergent compositions with relatively high quantities of nonionic surfactant may be required as detergent compositions in their own right or for dosing to other detergent compositions to increase the proportion of nonionic surfactant in the combined composition.

The present application relates both to the inclusion of nonionic surfactant in fully formulated granular detergent compositions and to nonionic-surfactant-containing granular compositions with high nonionic content for dosing to other detergent compositions.

Nonionic-surfactant-containing particles are disclosed for example in JP 08 027 498A (Kao), which discloses a silica based carrier having an oil absorption capacity of at least 80 ml/g and capable of providing a particle having up to 50% by weight of nonionic surfactant.

EP 521 635A (Unilever) discloses the use of zeolite P having a silicon to aluminium ratio not greater than 1.33 (otherwise called zeolite MAP) as a carrier for liquid, viscous-liquid, oily or waxy detergent ingredients such as nonionic surfactant. The zeolite MAP can be used in the form of a powder, granulate or as a component of a detergent composition.

Problems are now being experienced with the rate of dissolution of nonionic surfactant from granulates comprising nonionic surfactant absorbed in a carrier, referred to herein as dispersion. In particular, problems have been encountered such as poor dispersion of the powder into the wash water in the dispenser drawer of an automatic washing machine. A gritty, viscous mass may remain in the dispenser drawer. Further, powder compositions entrained in the wash water may not break-up and disperse adequately. Undispersed particles of powder compositions may remain in the wash water. These can adhere to clothes and cause local damage. Undissolved powder composition can remain on the clothes after washing. There may be particular dispersion problems where nonionic surfactant is absorbed onto carrier particles comprising a high proportion of aluminosilicate.

The structuring of nonionic surfactants, by forming a premix with a suitable structurant, prior to their use in preparing detergent powders is known.

U.S. Pat. No. 5,610,131 (Procter & Gamble) discloses granular high bulk density detergent compositions containing nonionic surfactant structured with a polymer. The polymer, e.g. polyvinyl pyrrolidone, is premixed with the nonionic surfactant. Another polymer, polyethylene glycol, is proposed in WO 94 09109A.

U.S. Pat. No. 3,868,336 (Lever Bros Co/Mazzola) discloses applying a liquid or oily "detergency improver" (a low-EO nonionic) to a detergent powder, and also applying a finely divided flow-promoting agent to reduce caking. Preferred flow-promoting aids are fine particulate water-soluble detergent ingredients, e.g. phosphates (e.g. STP), polymers (e.g. PVA), organic builders (e.g. ODS), SCMC, perborate. The detergency improver and the flow promoter are preferably added separately.

EP 622 454A (Procter & Gamble) discloses structuring of liquid nonionic surfactants prior to a granulation process: the structurants are polymers, preferably PVA, hydroxyacrylic polymers, PVP, PVNO, or sugars, or artificial sweeteners.

Granular laundry compositions containing liquid blends of nonionic surfactant and liquid anionic surfactants are known in the art, see for example, EP 0544 365A (Unilever), EP 0265 203A (Unilever), WO 92 06150A (Procter & Gamble) and U.S. Pat. No. 4,675,124 (Henkel).

The present inventors have now found that the rate of dissolution of nonionic-surfactant-containing granular compositions can be improved if the nonionic surfactant is structured by intimate admixture with a structurant, which is a fine particulate non-soap ionic surfactant, before preparing the granular composition.

DEFINITION OF THE INVENTION

In a first aspect, the present invention provides a nonionic-surfactant-containing granular composition, comprising:

(a) a structured surfactant blend, and (b) a granular carrier material, wherein the structured surfactant blend comprises (a)(i) a nonionic surfactant in intimate admixture with (a)(ii) a structurant which is a fine particulate non-soap ionic surfactant, the weight ratio of (a)(i) to (a)(ii) being within the range of from 20:1 to 1:1.

In a second aspect of the invention, there is provided a process for manufacturing the nonionic-surfactant-containing granular composition defined above, which process comprises:

i) blending a nonionic surfactant with a structurant, which is a fine particulate non-soap ionic surfactant, to produce a structured surfactant blend, followed by ii) mixing the structured surfactant blend with a granular carrier material.

In a third aspect, the present invention provides a particulate laundry detergent composition comprising from 5 to 60 wt % of surfactant, from 10 to 80 wt % of detergency builder and optionally other detergent ingredients, the composition being in the form of at least two particulate or granular components of which at least one is a nonionic-surfactant-containing granular composition as defined previously.

DETAILED DESCRIPTION OF THE INVENTION

Nonionic-Surfactant-Containing Granular Composition

The nonionic-surfactant-containing granular composition suitably comprises from 5 to 60 wt %, preferably from 15 to 50 wt %, of the structured surfactant blend, and from 40 to 95 wt %, preferably from 50 to 80 wt %, of the granular carrier material.

The ratio of nonionic surfactant to structurant is within the range of from 20:1 to 1:1 by weight. Preferably, they are present at a ratio within the range of from 10:1 to 1:1. Other minor ingredients such as water may be present at a level of preferably less than 5% by weight.

The granular composition of the present invention preferably has a bulk density in the range of from 400 to 1200 g/l.

The $d_{50}$ particle size is preferably in the range of from 200 to 1000 micrometers. The quantity $d_{50}$ indicates that 50 wt % of the particles have a diameter smaller than that figure. Particle size may be measured by any suitable method. For the purposes of the present invention particle sizes and distributions were measured using a Malvern Mastersizer (Trade Mark).

The Structurant

The structured surfactant blend comprises nonionic surfactant blended with an additional component, herein referred to as the structurant, intimately mixed therewith to provide a homogeneous dispersion. The structurant is included to improve the dissolution into water of the nonionic surfactant from the granular carrier material.

Without wishing to be bound by theory, it is believed that nonionic surfactant such as ethoxylated nonionic surfactant dissolves relatively slowly in wash water due to the formation of viscous mesophases. It is believed that the structurant acts as a phase behaviour modifier when intimately mixed with the nonionic surfactant, leading to improved dissolution in water.

The structurant, which is in finely divided particulate form, is selected from the class comprised by non-soap ionic surfactants. This class includes non-soap anionic, cationic, amphoteric and zwitterionic surfactants. Non-soap anionic surfactants are preferred.

Suitable non-soap anionic surfactants include alkyl benzene sulphonates, particularly linear alkyl benzene sulphonates having an alkyl chain length of $C_8$–$C_{15}$, primary or secondary alkyl sulphates, particularly $C_8$–$C_{15}$ primary alcohol sulphates, alkyl ether sulphates, olefin sulphonates, alkyl xylene sulphonates, dialkyl sulphosuccinates, fatty acid ester sulphonates or sodium or potassium salts of $C_8$–$C_{15}$ carboxylic acids.

A preferred anionic surfactant is primary alcohol sulphate. Another preferred anionic surfactant is fatty acid ester sulphonate.

Suitable cationic surfactants include alkyl trimethyl ammonium chlorides and/or bromides, wherein the alkyl moiety has an average of from 8 to 15 carbon atoms. Zwitterionic or amphoteric surfactants may also be used.

The structurant is present in the form of a finely divided particulate solid blended into the nonionic surfactant to provide a homogeneous dispersion.

In general, the particle size of the structurant is preferably small. Preferably the $d_{50}$ particle size lies within the range of from 1 to 50 micrometers.

The Granular Carrier Material

The granular carrier material must be capable of carrying the surfactant/water-insoluble liquid blend by absorption and/or adsorption. Thus the carrier material suitably has intraparticulate or interparticulate porosity.

Although it is not essential to the invention, it is preferred that the carrier material is substantially or completely water-insoluble.

Preferred carrier materials are crystalline alkali metal aluminosilicates (zeolites), and according to one preferred embodiment of the invention the granular carrier material comprises at least 76 wt %, preferably at least 80 wt %, alkali metal aluminosilicate. Most preferably the granular carrier material consists essentially of alkali metal aluminosilicate.

Aluminosilicates are materials having the general formula:

$$0.8\text{–}1.5M_2O.Al_2O_3.0.8\text{–}6SiO_2$$

where M is a monovalent cation, preferably sodium. These materials contain some bound water and are required to have a calcium ion exchange capacity of at least 50 mg CaO/g. The preferred sodium aluminosilicates contain 1.5–3.5 $SiO_2$ units in the formula above. They can be prepared readily by reaction between sodium silicate and sodium aluminate, as amply described in the literature. Preferred zeolites are zeolite MAP and zeolite A and mixtures thereof.

As alternatives to zeolites, other preferred granular carrier materials include the following:

silicas of appropriate oil absorption capacity
calcite
insoluble silicates
clays The granular carrier material may suitably comprise lesser amounts of additional components. Examples of such components are salts which have building properties, for example sodium carbonate, optionally combined with a calcite seed, sodium tripolyphosphate, layered silicates, for example SKS-6 (Trade Mark), amorphous aluminosilicate, organic builders such as polycarboxylate polymers, monomeric polycarboxylate such as citrate or mixtures thereof. The granular carrier material may also comprise non-builder solid materials such as sodium sulphate or sodium bicarbonate.

Nonionic Surfactant

Nonionic surfactants that may be used include the primary and secondary alcohol ethoxylates, especially $C_8$–$C_{20}$ primary and secondary aliphatic alcohols ethoxylated with an average of from 1 to 20 moles of ethylene oxide per mole of alcohol, and more especially the $C_9$–$C_{15}$ primary and secondary aliphatic alcohol ethoxylated with an average of from 1 to 10 moles of ethylene oxide per mole of alcohol.

Although the preferred nonionic surfactants are ethoxylated alcohols as detailed above, the invention is also applicable to non-ethoxylated nonionic surfactants, for example alkyl polyglycosides, glycerol monoethers, and polyhydroxy amides (glucamide).

The nonionic surfactant is preferably in the form of a liquid, viscous liquid or waxy material at ambient temperature.

The water level in the nonionic surfactant should desirably be sufficiently low to avoid the formation of a mesophase. Most commercially available nonionic surfactants, as supplied, satisfy this requirement. Preferably, the nonionic surfactant contains less than 5% by weight water, more preferably less than 2% by weight water.

Manufacture of the Nonionic-Surfactant-Containing Granular Composition

Typically the nonionic-surfactant-containing granular composition is made from a process which comprises (i) blending a liquid nonionic surfactant with a structurant, which is a fine particulate non-soap ionic surfactant, to produce a structured surfactant blend, followed by (ii) mixing the structured surfactant blend with a granular carrier material.

The structurant should be blended with the nonionic surfactant, most preferably by mixing the nonionic surfactant and structurant together to form a structured surfactant blend, before preparing the granular composition. Such mixing may be carried out, for example, in a Sirman (Trade Mark) mixer.

It is preferred that step (ii), the addition of the structured surfactant blend to the carrier material, is carried out in a high speed mixer/granulator.

The granular carrier material may be manufactured by any suitable method, for example by preparing an aqueous slurry of carrier material components and spray-drying them in a spray-drying tower. Alternatively, a granulate may be prepared by granulating the carrier material in a high speed mixer/granulator, either continuous or batch, for example a Lödige (Trade Mark) CB Recycler (continuous) or a Fukae (Trade Mark) mixer (batch). It may be necessary to-add a liquid in order to induce granulation of the powdered material from which the granulate is formed. The binder liquid may be water, or the nonionic surfactant may be added to the carrier components to act as a binder.

Other equipment suitable for use in the present invention include the Fukae mixer, produced by Fukae Powtech Co. of Japan, the Diosna V Series supplied by Dierks & Sohne Germany, the Pharma Matrix ex TK Fielder Ltd England, the Fuji V-C Series produced by Fuji Sangyo Company Japan and the Roto produced by Zanchetta & Company Srl, Italy. Other suitable equipment can include the Lödige Series CB for continuous high shear granulation available from Morton Machine Company, Scotland, and the Drais T160 Series manufactured by Drais Werke GmbH, Mannheim, Germany.

Detergent Compositions

The nonionic-surfactant-containing granular composition of the invention may form part of a particulate laundry detergent composition comprising from 5 to 60 wt % of surfactant, from 10 to 80 wt % of detergency builder and optionally other detergent ingredients, the composition being in the form of at least two particulate or granular components, at least one of which is the nonionic-surfactant-containing granule of the invention.

Thus the nonionic-surfactant-containing granular composition of the present invention may be mixed with other granular components to form a detergent composition, for example:

(a) a conventional spray-dried or agglomerated base powder granule containing anionic surfactant, builder and, optionally nonionic surfactant, and/or (b) a builder particle, and/or (c) a particle containing at least 50 wt %, preferably at least 60 wt %, of anionic surfactant.

The nonionic-surfactant-containing granular composition of the present invention may be mixed with conventional base powders in order to increase the nonionic surfactant content of the overall composition. Steps such as spraying nonionic surfactant onto base powder can then be reduced or avoided. High total quantities of nonionic surfactant in the mixture can be obtained. The nonionic-surfactant-containing granular composition of the present invention can be mixed with conventional base powders containing little or no nonionic surfactant or with builder granules.

The base powders or builder granules may be manufactured by any suitable process. For example, they may be produced by spray-drying, spray-drying followed by densification in a batch or continuous high speed mixer/densifier or by a wholly non-tower route comprising granulation of components in a mixer/densifier, preferably in a low shear mixer/densifier such as a pan granulator or fluidised bed mixer.

Preferably, the nonionic-surfactant-containing granular composition of the invention provides at least 40% by weight, preferably at least 50% by weight of the total composition.

The separately produced granular components may be dry-mixed together in any suitable apparatus.

The detergent compositions of the present invention may include additional powdered components dry-mixed with the granular component. Suitable components which may be post-dosed to the granular components will be discussed further below.

Other Detergent Ingredients

Detergent compositions according to the invention may also suitably contain a bleach system. It is preferred that the compositions of the invention contain peroxy bleach compounds capable of yielding hydrogen peroxide in aqueous solution, for example inorganic or organic peroxyacids, and inorganic persalts such as the alkali metal perborates, percarbonates, perphosphates, persilicates and persulphates. Bleach ingredients are generally post-dosed as powders.

The peroxy bleach compound, for example sodium percarbonate, is suitably present in an amount of from 5 to 35 wt %, preferably from 10 to 25 wt %.

The peroxy bleach compound, for example sodium percarbonate, may be used in conjunction with a bleach activator (bleach precursor) to improve bleaching action at low wash temperatures. The bleach precursor is suitably present in an amount of from 1 to 8 wt %, preferably from 2 to 5 wt %.

Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED).

A bleach stabiliser (heavy metal sequestrant) may also be present. Suitable bleach stabilisers include ethylenediamine tetraacetate (EDTA) and the polyphosphonates such as Dequest (Trade Mark), EDTMP. A bleach catalyst may also be included.

The detergent compositions of the invention may also contain alkali metal, preferably sodium, carbonate, in order to increase detergency and ease processing. Sodium carbonate may suitably be present in amounts ranging from 1 to 60 wt %, preferably from 2 to 40 wt %. However, compositions containing little or no sodium carbonate are also within the scope of the invention. Sodium carbonate may be included in granular components, or post-dosed, or both.

The detergent composition of the invention may contain water-soluble alkali metal silicate, preferably sodium silicate having a $SiO_2$:$Na_2O$ mole ratio within the range of from 1.6:1 to 4:1. The water-soluble silicate may be present in an amount of from 1 to 20 wt %, preferably 3 to 15 wt % and more preferably 5 to 10 wt %, based on the aluminosilicate (anhydrous basis).

Other materials that may be present in detergent compositions of the invention include antiredeposition agents such as cellulosic polymers; soil release polymers; fluorescers; inorganic salts such as sodium sulphate; lather control agents or lather boosters as appropriate; proteolytic and lipolytic enzymes; dyes; coloured speckles; perfumes; foam controllers; and fabric softening compounds.

EXAMPLES

The present invention will be further described by way of the following non-limiting Examples. Except where stated otherwise, all quantities are in parts by weight.

Test Method (Flowcell) for Rate of Dispersion

The rate of dispersion is studied using an apparatus named a flowcell. A flowcell comprises a perspex container defining a flow path. The internal volume of the flow path is 4.5 $dm^3$ and has a depth of 2.5 cm. In use, the flowcell is illuminated so that the flow path can be visually inspected. For example, the flowcell may be viewed using a video camera or it may be placed on a microscope for microscopic viewing of particle dissolution. The flow channel in the flowcell is connected to a supply of water so that water can flow into the flowcell and out to a drain.

In the experiment, 1.0 g of powder was placed in a small heap in the flow passage in the flowcell. The powder bed was wetted for 60 seconds. This allows the bed to fuse together such that dispersion and not dispensing is monitored. Then, water was allowed to flow through the flowcell at a rate of 4.5 cm/second, giving an approximate Reynolds number of 400. The behaviour of the powder was then observed. The time required for all the powder to be removed by the flow of water was recorded.

Examples 1 to 5 and Comparative Examples A to E

In these Examples, a finely divided particulate non-soap anionic surfactant was used to structure nonionic surfactant. The Examples show the critical importance of intimate mixing between the structurant and the nonionic surfactant.

The inorganic carriers used were zeolite 4A (Wessalith (Trade Mark) P ex Degussa), zeolite MAP (Doucil (TradeMark) A24 ex Crosfield), and silica (Sorbicil TC15 (Trade Mark) ex Crosfield). The nonionic surfactant was $C_{12}$–$C_{13}$, 6.5EO (Dobanol (Trade Mark) 23 6.5 EO, ex Shell). The structurants used were sodium dodecyl sulphate (SDS) and fatty acid ester sulphonate (FAES) which were both pure materials, ex BDH.

The $d_{50}$ particle size of the structurant was 10 micrometers. Particle size was measured using a Malvern Mastersizer (Trade Mark).

For Examples 1 to 5, a structured surfactant blend was manufactured by placing the nonionic surfactant and structurant in a bench-top Sirman (Trade Mark) mixer. The components were mixed for 10 minutes. Thereafter, inorganic carrier material was added and the three components were granulated for a further 5 minutes. This procedure involved intimate mixing of the nonionic surfactant and the structurant particles before the inorganic carrier was added.

For Comparative Examples A to E, the inorganic carrier material and nonionic surfactant were granulated together. Thereafter the structurant, in fine powdered form, was added and all three components were granulated for a further 10 seconds. In this procedure there was no intimate mixing of the nonionic surfactant and the structurant.

The powder samples of Example 1 to 5 and Comparative Examples A to E were subjected to a flowcell test to determine how quickly they dispersed in water. Dispersion times (minutes) are shown in Table 1 below.

TABLE 1

| | 1 | A | 2 | B | 3 | C | 4 | D | 5 | E |
|---|---|---|---|---|---|---|---|---|---|---|
| Zeolite 4A | 73 | 73 | 75 | 75 | — | — | 75 | 75 | — | — |
| Zeolite MAP | — | — | — | — | 75 | 75 | — | — | — | — |
| Silica | — | — | — | — | — | — | — | — | 50 | 50 |
| Dobanol* | 19 | 19 | 18 | 18 | 18 | 18 | 18 | 18 | 35 | 35 |
| FAES | — | — | 7 | 7 | — | — | — | — | 15 | 15 |
| SDS | 8 | 8 | — | — | 7 | 7 | 7 | 7 | — | — |
| Dispersion time | 6 | 10 | 6 | 19 | 7 | 17 | 7 | 16 | 4 | 15 |

*Dobanol (Trade Mark) 23 6.5 EO, ex Shell

Accordingly, it can be seen that the powders according to the present invention disperse much more rapidly than those of the comparative examples.

We claim:

1. A nonionic-surfactant-containing granular composition, comprising:

(a) a structured surfactant blend, and (b) a granular carrier material, wherein the structured surfactant blend (a) comprises (a)(i) a nonionic surfactant in intimate admixture with (a)(ii) a structurant which is a fine particulate non-soap ionic surfactant having a $d_{50}$ particle size within the range of from 1 to 50 micrometres, the weight ratio of (a)(i) to (a)(ii) being within the range of from 20:1 to 1:1.

2. A composition as claimed in claim 1, wherein the weight ratio of (a)(i) to (a)(ii) is within the range of from 10:1 to 1:1.

3. A composition as claimed in claim 1, which comprises:

(a) from 5 to 60 wt%, preferably from 15 to 50 wt%, of the structured surfactant blend, and (b) from 40 to 95 wt%, preferably from 50 to 80 wt%, of the granular carrier material.

4. A composition as claimed in claim 1, wherein the structurant comprises a non-soap anionic surfactant.

5. A composition as claimed in claim 4, wherein the structurant comprises a primary alcohol sulphate.

6. A composition as claimed in claim 4, wherein the structurant comprises a fatty acid ester sulphonate.

7. A composition as claimed in claim 1, wherein the granular carrier material is substantially or completely water-insoluble.

8. A composition as claimed in claim 1, wherein the granular carrier material is selected from alkali metal aluminosilicates, silicas, silicates, clays, and calcite.

9. A composition as claimed in claim 8, wherein the granular carrier material comprises a crystalline alkali metal aluminosilicate selected from zeolite A, zeolit MAP, and mixtures thereof.

10. A composition as claimed in claim 8, wherein the granular carrier material comprises at least 76 wt%, preferably at least 80 wt%, alkali metal aluminosilicate.

11. A composition as claimed in claim 8, wherein the granular carrier material consists essentially of alkali metal aluminosilicate.

12. A composition as claimed in claim 1, wherein the nonionic surfactant is in the form of a liquid, viscous liquid or waxy material at ambient temperature.

13. A composition as claimed in claim 1, wherein the nonionic surfactant is an ethoxylated alcohol.

14. A composition as claimed in claim 13, wherein the nonionic surfactant comprises a $C_8$-$C_{20}$ primary or secondary aliphatic alcohol ethoxylated with an average of from 1 to 20 moles of ethylene oxide per mole of alcohol.

15. A process for manufacturing a nonionic-surfactant-containing granular composition as claimed claim 1, which process comprises:

(i) blending the nonionic surfactant with the structurant, which is a fine particulate non-soap ionic surfactant, to produce the structured surfactant blend, followed by (ii) mixing the structured surfactant blend with the granular carrier material.

16. A process as claimed in claim 15, wherein the granular carrier material is produced by spray-drying an aqueous slurry.

17. A process as claimed in claim 15, wherein the granular carrier material is prepared by granulation in a high speed mixer/granulator.

18. A process as claimed in claim 15, wherein step (ii) is carried out in a high speed mixer/granulator.

19. A particulate laundry detergent composition comprising from 5 to 60 wt% of surfactant, from 10 to 80 wt% of detergency builder and optionally other detergent ingredients, the composition being in the form of at least two particulate or granular components of which at least one is a nonionic-surfactant-containing granular composition as claimed in claim 1.

* * * * *